US008146797B2

(12) United States Patent
D'Amato

(10) Patent No.: US 8,146,797 B2
(45) Date of Patent: Apr. 3, 2012

(54) INSULATED CUP

(75) Inventor: Gianfranco D'Amato, Arzano Naples (IT)

(73) Assignee: Seda S.p.A., Arzano Napoli (IT)

( * ) Notice: Subject to any disclaimer, the term of this patent is extended or adjusted under 35 U.S.C. 154(b) by 28 days.

(21) Appl. No.: 12/093,253

(22) PCT Filed: Nov. 9, 2006

(86) PCT No.: PCT/EP2006/010767

§ 371 (c)(1),
(2), (4) Date: Oct. 7, 2008

(87) PCT Pub. No.: WO2007/054318

PCT Pub. Date: May 18, 2007

(65) Prior Publication Data

US 2009/0020597 A1 Jan. 22, 2009

(30) Foreign Application Priority Data

Nov. 11, 2005 (EP) ..... 05024667

(51) Int. Cl.
*B65D 3/04* (2006.01)

(52) U.S. Cl. ..... 229/403; 229/4.5

(58) Field of Classification Search ..... 229/403, 229/91, 87.18, 203, 89

See application file for complete search history.

(56) References Cited

U.S. PATENT DOCUMENTS

| | | | |
|---|---|---|---|
| 23,200 | A | 3/1859 | Stimpson |
| 1,031,514 | A | 7/1912 | Björkstam et al. |
| 1,520,870 | A | 12/1924 | Koch |
| 1,549,417 | A | 8/1925 | Hendrich |
| 1,615,319 | A | 1/1927 | Wynn |
| 1,654,318 | A | 12/1927 | Benson |
| 1,685,494 | A | 9/1928 | Koch |

(Continued)

FOREIGN PATENT DOCUMENTS

| | | |
|---|---|---|
| AR | 047625 | 2/2006 |

(Continued)

OTHER PUBLICATIONS

Statement of Case in Opposition to New Zealand Patent Application No. 543602, Mar. 22, 2007, 79 paqes.

(Continued)

*Primary Examiner* — Nathan J Newhouse

*Assistant Examiner* — Christopher Demeree

(74) *Attorney, Agent, or Firm* — Fish & Richardson P.C.

(57) ABSTRACT

Cup (1) with an internal wall (2) and an external sleeve (5), the sleeve being formed from a blank (10) of corrugated material comprising a corrugated layer (6) and a Substrate layer (7) and being arranged such that the Substrate layer (7) faces towards the internal wall of the cup. A first end (12) of the blank (10) is overlapped at least partially by a second end (14) of the blank in an overlapping area (19). Further, the sleeve (5) is adhesively attached to the internal wall of the cup (1) at least by a first area (15) of adhesive being provided on an inner side of the sleeve on the first end of the blank and by a second area (17) of adhesive being provided on an inner side of the sleeve on the second end of the blank. The second area (17) of adhesive is provided at a distance from the overlapping edge (13) of the blank, thereby attaching each end of the blank (10) separately to the internal wall of the cup (1).

24 Claims, 6 Drawing Sheets

U.S. PATENT DOCUMENTS

Figure 1:
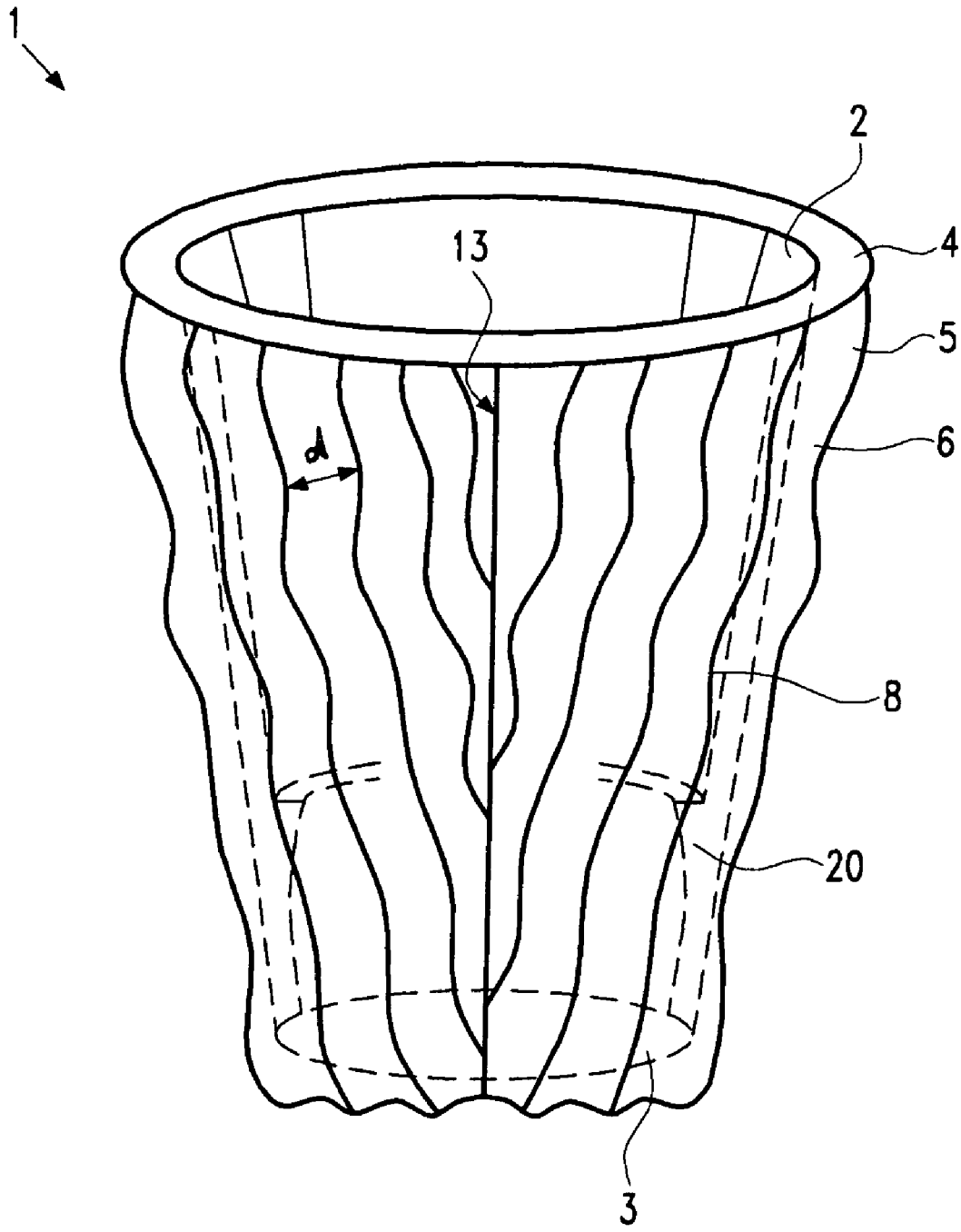

| | | | | |
|---|---|---|---|---|
| 1,706,910 | A | | 3/1929 | Wright et al. |
| 1,756,243 | A | | 4/1930 | Benson |
| 1,759,407 | A | | 5/1930 | Kingsbury |
| 1,814,671 | A | | 7/1931 | Dufour |
| 2,053,726 | A | | 9/1936 | Marshall |
| 2,134,427 | A | | 10/1938 | Biderman |
| 2,156,328 | A | | 5/1939 | Barbieri |
| 2,157,054 | A | | 5/1939 | Gammeter |
| 2,288,602 | A | | 5/1939 | Benton |
| 2,170,060 | A | | 8/1939 | Meyer |
| 2,216,331 | A | | 10/1940 | Swallow et al. |
| 2,226,340 | A | | 12/1940 | Flood |
| 2,235,963 | A | | 3/1941 | McGirr et al. |
| 2,240,599 | A | | 5/1941 | Amberg |
| 2,266,828 | A | | 12/1941 | Sykes |
| 2,416,813 | A | | 3/1947 | Barbieri |
| 2,462,497 | A | | 2/1949 | Heyman |
| 2,493,633 | A | | 1/1950 | Mart |
| 2,540,565 | A | * | 2/1951 | Barbieri ..... 229/5.5 |
| 2,563,352 | A | | 8/1951 | Morse |
| 2,591,578 | A | | 4/1952 | McNealy et al. |
| 2,661,889 | A | | 12/1953 | Phinney |
| 2,666,542 | A | | 1/1954 | Price |
| 2,675,954 | A | | 4/1954 | Vogel |
| 2,689,424 | A | | 9/1954 | Clagett |
| 2,692,722 | A | | 10/1954 | Johnson |
| 2,695,744 | A | | 11/1954 | Gattuso |
| 2,721,686 | A | | 10/1955 | Reifsnyder et al. |
| 2,725,733 | A | | 12/1955 | Howlett |
| 2,740,575 | A | | 4/1956 | Fontaine |
| 2,828,903 | A | | 4/1958 | Adkins |
| 2,863,585 | A | | 12/1958 | Meshberg |
| 2,888,861 | A | | 6/1959 | Meyer-Jagensberg |
| 2,899,098 | A | | 8/1959 | Gits |
| 2,982,465 | A | | 5/1961 | Fallert |
| 3,065,875 | A | | 11/1962 | Negoro |
| 3,079,027 | A | | 2/1963 | Edwards |
| 3,082,900 | A | | 3/1963 | Goodman |
| 3,109,252 | A | | 11/1963 | Schellenberg |
| 3,118,351 | A | | 1/1964 | Meyer-Jagensberg |
| 3,139,213 | A | | 6/1964 | Edwards |
| RE25,618 | E | | 7/1964 | Goodman |
| 3,208,631 | A | | 9/1965 | Edwards |
| 3,225,954 | A | | 12/1965 | Herrick et al. |
| 3,232,512 | A | | 2/1966 | Wanderer |
| 3,298,893 | A | | 1/1967 | Allen |
| 3,355,046 | A | | 11/1967 | Jolly |
| 3,357,053 | A | | 12/1967 | Lyon et al. |
| 3,372,830 | A | | 3/1968 | Edwards |
| 3,401,862 | A | | 9/1968 | Wanderer |
| 3,428,214 | A | | 2/1969 | Leon |
| 3,443,714 | A | | 5/1969 | Edwards |
| 3,456,860 | A | | 7/1969 | Janninck |
| 3,471,075 | A | | 10/1969 | Wolf |
| 3,485,412 | A | | 12/1969 | Hawley |
| 3,526,316 | A | | 9/1970 | Kalogris |
| 3,531,015 | A | | 9/1970 | Makin |
| 3,580,468 | A | | 5/1971 | McDevitt |
| 3,583,596 | A | | 6/1971 | Brewer |
| 3,612,346 | A | | 10/1971 | Schneider et al. |
| 3,645,758 | A | | 2/1972 | MacManus |
| 3,700,018 | A | | 10/1972 | Goglio |
| 3,737,093 | A | | 6/1973 | Amberg et al. |
| 3,739,975 | A | | 6/1973 | Davidow |
| 3,747,830 | A | | 7/1973 | Goldman |
| 3,749,277 | A | | 7/1973 | Kinney |
| 3,765,559 | A | | 10/1973 | Sauey et al. |
| 3,766,975 | A | | 10/1973 | Todd |
| D231,068 | S | | 4/1974 | Douglas |
| 3,836,207 | A | | 9/1974 | Belart |
| 3,846,207 | A | | 11/1974 | MacDaniel et al. |
| 3,850,361 | A | | 11/1974 | Day et al. |
| 3,878,282 | A | | 4/1975 | Bonis et al. |
| 3,884,350 | A | | 5/1975 | Johansson |
| 3,908,523 | A | * | 9/1975 | Shikaya ..... 493/111 |
| 3,926,361 | A | | 12/1975 | Hilderbrand |
| 3,927,766 | A | | 12/1975 | Day |
| 3,934,749 | A | | 1/1976 | Andrulionis |
| 3,955,697 | A | | 5/1976 | Valyi |
| 4,007,670 | A | | 2/1977 | Albano et al. |
| 4,018,904 | A | | 4/1977 | Muraoka |
| 4,040,537 | A | | 8/1977 | Edwards |
| 4,049,122 | A | | 9/1977 | Maxwell |
| 4,070,953 | A | | 1/1978 | Richards et al. |
| 4,089,358 | A | | 5/1978 | Korson |
| 4,102,454 | A | | 7/1978 | Karevaara et al. |
| 4,124,120 | A | | 11/1978 | Day |
| 4,129,065 | A | | 12/1978 | Corse et al. |
| 4,187,768 | A | | 2/1980 | Suzuki |
| 4,211,024 | A | | 7/1980 | Nickell |
| 4,231,476 | A | | 11/1980 | Compton et al. |
| 4,261,501 | A | | 4/1981 | Watkins et al. |
| 4,292,194 | A | | 9/1981 | Perazzoni et al. |
| 4,308,679 | A | | 1/1982 | Ray, III et al. |
| 4,318,235 | A | | 3/1982 | Augeri |
| 4,324,338 | A | | 4/1982 | Beall |
| 4,327,136 | A | | 4/1982 | Thompson et al. |
| 4,344,814 | A | | 8/1982 | McLaren |
| 4,345,393 | A | | 8/1982 | Price et al. |
| 4,368,818 | A | | 1/1983 | Day et al. |
| 4,409,045 | A | | 10/1983 | Busse |
| 4,409,122 | A | | 10/1983 | Kleuskens et al. |
| 4,514,242 | A | | 4/1985 | MacLaughlin et al. |
| 4,548,348 | A | | 10/1985 | Clements |
| 4,551,365 | A | | 11/1985 | Bonis |
| 4,560,075 | A | | 12/1985 | Lu |
| 4,571,233 | A | | 2/1986 | Konzal |
| 4,574,987 | A | | 3/1986 | Halligan et al. |
| 4,581,003 | A | | 4/1986 | Iro et al. |
| 4,684,553 | A | | 8/1987 | Sasaki et al. |
| 4,706,873 | A | | 11/1987 | Schulz |
| 4,771,911 | A | | 9/1988 | Morony et al. |
| 4,775,523 | A | | 10/1988 | Sparacio et al. |
| 4,789,073 | A | | 12/1988 | Fine |
| 4,792,042 | A | | 12/1988 | Koehn et al. |
| 4,813,862 | A | | 3/1989 | Bowers et al. |
| 4,850,496 | A | | 7/1989 | Rudell et al. |
| 4,863,014 | A | | 9/1989 | Summons et al. |
| 4,936,448 | A | | 6/1990 | Holloway |
| 4,955,503 | A | | 9/1990 | Propes |
| 4,993,580 | A | | 2/1991 | Smith |
| 4,997,691 | A | | 3/1991 | Parkinson |
| 5,007,578 | A | | 4/1991 | Simone |
| 5,021,274 | A | | 6/1991 | Beck et al. |
| 5,025,981 | A | | 6/1991 | Schellenberg |
| 5,062,568 | A | | 11/1991 | Hill et al. |
| 5,076,463 | A | | 12/1991 | McGraw |
| 5,078,313 | A | | 1/1992 | Matheson et al. |
| 5,092,485 | A | | 3/1992 | Lee |
| 5,135,132 | A | | 8/1992 | Potochnik |
| 5,145,107 | A | | 9/1992 | Silver et al. |
| 5,226,585 | A | | 7/1993 | Varano |
| 5,253,781 | A | | 10/1993 | Van Melle et al. |
| 5,363,982 | A | | 11/1994 | Sadlier |
| 5,385,260 | A | | 1/1995 | Gatcomb |
| 5,395,005 | A | | 3/1995 | Yoshida |
| 5,425,497 | A | | 6/1995 | Sorensen |
| 5,425,498 | A | | 6/1995 | Hallam et al. |
| 5,460,323 | A | | 10/1995 | Titus |
| 5,484,167 | A | | 1/1996 | Donaldson et al. |
| 5,489,063 | A | | 2/1996 | Buchalski et al. |
| 5,524,817 | A | | 6/1996 | Meier et al. |
| 5,542,599 | A | | 8/1996 | Sobol |
| 5,547,124 | A | | 8/1996 | Mueller |
| 5,551,592 | A | | 9/1996 | Barton et al. |
| 5,553,735 | A | | 9/1996 | Kimura |
| 5,573,141 | A | | 11/1996 | Chen |
| 5,586,689 | A | | 12/1996 | D'Amato et al. |
| 5,593,053 | A | | 1/1997 | Kaufman et al. |
| 5,603,450 | A | | 2/1997 | Whitnell |
| 5,628,453 | A | | 5/1997 | MacLaughlin |
| 5,660,326 | A | | 8/1997 | Varano et al. |
| 5,660,898 | A | | 8/1997 | Calvert |
| 5,671,353 | A | | 9/1997 | Tian et al. |
| 5,674,546 | A | | 10/1997 | Barnes et al. |
| 5,678,725 | A | | 10/1997 | Yamada et al. |
| 5,685,480 | A | | 11/1997 | Choi |

5,697,550 A 12/1997 Varano et al.
5,713,512 A 2/1998 Barrett
5,752,653 A 5/1998 Razzaghi
RE35,830 E 6/1998 Sadlier
5,769,262 A 6/1998 Yamada et al.
5,769,311 A 6/1998 Morita et al.
5,772,111 A 6/1998 Kirsch
5,794,843 A 8/1998 Sanchez
5,820,016 A 10/1998 Stropkay
5,823,948 A 10/1998 Ross, Jr. et al.
5,839,599 A 11/1998 Lin
5,839,653 A 11/1998 Zadravetz
5,894,948 A 4/1999 Yeh
5,903,889 A 5/1999 de la Huerga et al.
5,913,449 A 6/1999 Branch et al.
5,918,761 A 7/1999 Wissinger
5,944,208 A 8/1999 Gale
5,950,917 A 9/1999 Smith
5,953,419 A 9/1999 Lohstroh et al.
5,954,217 A 9/1999 Brkovic et al.
5,956,400 A 9/1999 Chaum et al.
5,964,400 A 10/1999 Varano et al.
5,975,344 A 11/1999 Stevens
5,996,887 A 12/1999 Cai et al.
6,036,801 A 3/2000 Yamada et al.
6,047,488 A 4/2000 Tuszkiewicz
6,050,443 A 4/2000 Tung
6,056,144 A 5/2000 Strange et al.
6,065,632 A 5/2000 Moore, Jr.
6,068,181 A 5/2000 Cai
6,076,699 A 6/2000 Seager et al.
6,085,970 A 7/2000 Sadlier
6,109,518 A 8/2000 Mueller et al.
6,116,503 A 9/2000 Varano
6,126,584 A 10/2000 Zadravetz
6,145,656 A 11/2000 Marco
6,148,342 A 11/2000 Ho
6,161,720 A 12/2000 Castle
6,193,098 B1 2/2001 Mochizuki et al.
6,196,454 B1 3/2001 Sadlier
6,210,766 B1 4/2001 McLaughlin
6,224,954 B1 5/2001 Mitchell et al.
6,237,845 B1 5/2001 Hashimoto et al.
6,253,995 B1 7/2001 Blok et al.
6,257,485 B1 7/2001 Sadlier et al.
6,260,021 B1 7/2001 Wong et al.
6,260,756 B1 7/2001 Mochizuki et al.
6,263,330 B1 7/2001 Bessette et al.
6,265,040 B1 7/2001 Neale et al.
6,286,754 B1 * 9/2001 Stier et al. ..... 229/403
6,287,247 B1 9/2001 Dees et al.
6,315,150 B1 11/2001 Takai et al.
6,315,192 B1 11/2001 Marlow
6,332,538 B1 12/2001 Pritchard
6,343,735 B1 2/2002 Cai
6,367,652 B1 4/2002 Toida et al.
6,378,763 B1 4/2002 Nelson et al.
6,378,766 B2 4/2002 Sadlier
6,382,449 B1 5/2002 Kazmierski et al.
6,401,955 B1 6/2002 Yang et al.
6,419,108 B1 7/2002 Toida et al.
6,422,456 B1 7/2002 Sadlier
6,424,996 B1 7/2002 Killcommons et al.
6,449,621 B1 9/2002 Pettovello
6,457,585 B1 10/2002 Huffer et al.
6,463,417 B1 10/2002 Schoenberg
6,557,102 B1 4/2003 Wong et al.
6,557,751 B2 * 5/2003 Puerini ..... 229/402
6,562,270 B1 5/2003 Gannon et al.
6,568,587 B1 5/2003 Yamada et al.
6,574,629 B1 6/2003 Cooke, Jr. et al.
6,574,742 B1 6/2003 Jamroga et al.
6,598,786 B1 7/2003 Guo
6,611,846 B1 8/2003 Stoodley et al.
6,612,456 B1 9/2003 Hundley et al.
6,648,176 B1 11/2003 Donovan
6,651,060 B1 11/2003 Harper et al.
6,663,926 B1 12/2003 Okushita et al.
6,678,703 B2 1/2004 Rothschild et al.
6,678,764 B2 1/2004 Parvulescu et al.
6,688,487 B2 2/2004 Oakes et al.
6,691,134 B1 2/2004 Babula et al.
6,738,798 B1 5/2004 Ploetz et al.
6,746,743 B2 6/2004 Knoerzer et al.
6,749,913 B2 6/2004 Watanabe et al.
6,763,344 B1 7/2004 Osentoski et al.
6,775,670 B2 8/2004 Bessette et al.
6,811,843 B2 11/2004 DeBraal et al.
6,852,381 B2 2/2005 Debraal et al.
6,908,651 B2 6/2005 Watanabe et al.
6,921,179 B2 7/2005 Ghanem
6,926,197 B2 8/2005 Hed et al.
6,989,198 B2 1/2006 Masuda et al.
7,100,770 B2 9/2006 D'Amato
7,117,579 B2 10/2006 Schellenberg
7,172,086 B2 2/2007 McKendry et al.
7,175,585 B2 2/2007 Okushita et al.
7,195,805 B2 3/2007 Breining et al.
D546,625 S 7/2007 Gluck
D547,122 S 7/2007 Gluck
D550,033 S 9/2007 Bodum
D550,034 S 9/2007 Bodum
D551,502 S 9/2007 Bodum
D553,437 S 10/2007 Bodum
D553,439 S 10/2007 Bodum
D553,440 S 10/2007 Bodum
D553,442 S 10/2007 Bodum
D553,909 S 10/2007 Bodum
D553,910 S 10/2007 Bodum
D553,911 S 10/2007 Bodum
7,281,650 B1 10/2007 Milan
D557,561 S 12/2007 Flowers et al.
D557,563 S 12/2007 Bodum
D557,564 S 12/2007 Bodum
7,306,113 B2 12/2007 El-Saden et al.
D562,075 S 2/2008 Mehta
D563,172 S 3/2008 Bodum
7,344,038 B2 3/2008 Elansary
D577,260 S 9/2008 Bodum
7,451,910 B2 11/2008 Frost et al.
7,451,911 B2 11/2008 Stepanek, Jr.
D581,738 S 12/2008 Bodum
D581,739 S 12/2008 Bodum
7,458,504 B2 12/2008 Robertson et al.
7,481,356 B2 1/2009 Stahlecker et al.
7,536,767 B2 5/2009 Hollis et al.
D594,277 S 6/2009 Snell
D595,090 S 6/2009 Benson
7,552,841 B2 6/2009 Hollis et al.
D597,791 S 8/2009 Lion et al.
D597,792 S 8/2009 Lion et al.
7,597,246 B2 10/2009 Stepanek, Jr.
7,631,781 B2 12/2009 Chen
7,677,435 B2 3/2010 Stahlecker
7,694,843 B2 4/2010 Hollis et al.
7,699,216 B2 4/2010 Smith et al.
7,717,325 B2 5/2010 Puls et al.
2001/0013537 A1 * 8/2001 Sadlier ..... 229/4.5
2001/0032100 A1 10/2001 Mahmud et al.
2001/0041991 A1 11/2001 Segal et al.
2002/0010679 A1 1/2002 Felsher
2002/0043555 A1 4/2002 Mader
2002/0148832 A1 10/2002 Breining et al.
2002/0156650 A1 10/2002 Klein et al.
2002/0172818 A1 11/2002 DeBraal et al.
2003/0029876 A1 2/2003 Giraud
2003/0088441 A1 5/2003 McNerney
2003/0116576 A1 6/2003 Lang-Boecker
2003/0121189 A1 7/2003 Williams
2003/0121963 A1 7/2003 Van Handel
2003/0140044 A1 7/2003 Mok et al.
2003/0226882 A1 12/2003 Porchia et al.
2004/0034550 A1 2/2004 Menschik et al.
2004/0069311 A1 4/2004 Sasaki et al.
2004/0094612 A1 5/2004 D'Amato
2004/0112949 A1 6/2004 Hed et al.
2004/0133797 A1 7/2004 Arnold
2004/0139222 A1 7/2004 Slik et al.

| | | | | |
|---|---|---|---|---|
| 2004/0154156 | A1 | 8/2004 | Schellenberg | |
| 2004/0199765 | A1 | 10/2004 | Kohane et al. | |
| 2004/0226948 | A1 | 11/2004 | Okushita et al. | |
| 2005/0006385 | A1 | 1/2005 | D'Amato | |
| 2005/0029337 | A1 | 2/2005 | Van Handel | |
| 2005/0040218 | A1 | 2/2005 | Hinchey et al. | |
| 2005/0045643 | A1 | 3/2005 | Ghanem | |
| 2005/0115975 | A1 | 6/2005 | Smith et al. | |
| 2005/0184074 | A1 | 8/2005 | Simmons et al. | |
| 2005/0199697 | A1 | 9/2005 | Nugent | |
| 2005/0205651 | A1 | 9/2005 | Marx | |
| 2005/0236468 | A1* | 10/2005 | Sadlier | 229/403 |
| 2005/0258225 | A1 | 11/2005 | Martin | |
| 2005/0269390 | A1 | 12/2005 | Martin | |
| 2006/0038001 | A1 | 2/2006 | Stepanek | |
| 2006/0118608 | A1 | 6/2006 | Stahlecker | |
| 2006/0131316 | A1 | 6/2006 | Bresler | |
| 2006/0144915 | A1 | 7/2006 | Sadlier | |
| 2006/0186012 | A1 | 8/2006 | D'Amato | |
| 2006/0226210 | A1 | 10/2006 | Stahlecker | |
| 2006/0237465 | A1 | 10/2006 | D'Amato | |
| 2006/0283855 | A1 | 12/2006 | Hollis et al. | |
| 2006/0289610 | A1 | 12/2006 | Kling | |
| 2007/0262129 | A1 | 11/2007 | Zadravetz | |
| 2007/0284426 | A1 | 12/2007 | Lo | |
| 2008/0006643 | A1 | 1/2008 | Ma | |
| 2008/0023536 | A1 | 1/2008 | Frost et al. | |
| 2008/0023537 | A1 | 1/2008 | Frost et al. | |
| 2008/0023538 | A1 | 1/2008 | Robertson et al. | |
| 2008/0029588 | A1 | 2/2008 | Messerschmid et al. | |
| 2008/0078825 | A1 | 4/2008 | Puls et al. | |
| 2008/0087677 | A1 | 4/2008 | Robertson et al. | |
| 2008/0087715 | A1 | 4/2008 | Robert son et al. | |
| 2008/0087716 | A1 | 4/2008 | Sadlier | |
| 2008/0093434 | A1 | 4/2008 | Van Handel | |
| 2008/0105692 | A1 | 5/2008 | Hiromori | |
| 2008/0105693 | A1 | 5/2008 | Hechmati | |
| 2008/0121681 | A1 | 5/2008 | Wiedmeyer | |
| 2008/0128433 | A1 | 6/2008 | Stauffer et al. | |
| 2008/0128481 | A1 | 6/2008 | Robertson | |
| 2008/0156857 | A1 | 7/2008 | Johnston | |
| 2008/0169297 | A1 | 7/2008 | Kelly | |
| 2008/0264937 | A1 | 10/2008 | D'Amato | |
| 2008/0272118 | A1 | 11/2008 | Wang | |
| 2008/0280743 | A1 | 11/2008 | Stahlecker et al. | |
| 2008/0302800 | A1 | 12/2008 | Chou | |
| 2008/0308620 | A1 | 12/2008 | Stepanek, Jr. | |
| 2009/0020597 | A1 | 1/2009 | D'Amato | |
| 2009/0110782 | A1 | 4/2009 | Mellor | |
| 2009/0121007 | A1 | 5/2009 | Van Handel | |
| 2009/0159653 | A1 | 6/2009 | Stahlecker | |
| 2009/0166402 | A1 | 7/2009 | D'amato | |
| 2009/0170680 | A1 | 7/2009 | D'amato | |
| 2009/0184020 | A1 | 7/2009 | Messerschmid et al. | |
| 2009/0218390 | A1 | 9/2009 | Chang | |
| 2009/0230178 | A1 | 9/2009 | Stahlecker et al. | |
| 2009/0294456 | A1 | 12/2009 | Messerschmid | |
| 2009/0294520 | A1 | 12/2009 | Stepanek, Jr. | |
| 2009/0321440 | A1 | 12/2009 | Fedusa et al. | |
| 2009/0321508 | A1 | 12/2009 | Fu et al. | |
| 2010/0025283 | A1 | 2/2010 | Oshima et al. | |
| 2010/0044424 | A1 | 2/2010 | Van Handel | |
| 2010/0065622 | A1 | 3/2010 | Chang | |
| 2010/0072268 | A1 | 3/2010 | Johnson et al. | |
| 2010/0160130 | A1 | 6/2010 | Messerschmid | |
| 2010/0187296 | A1 | 7/2010 | Puls et al. | |

FOREIGN PATENT DOCUMENTS

| | | | |
|---|---|---|---|
| AT | 141212 | T | 8/1996 |
| AT | 263709 | T | 4/2004 |
| AU | 4557993 | A | 3/1994 |
| AU | 2008264158 | A1 | 8/2009 |
| AU | 2009200641 | A1 | 10/2009 |
| BE | 410215 | A | 7/1935 |
| BE | 897862 | A1 | 3/1984 |
| BR | PI0900078 | A2 | 9/2009 |
| CA | 742539 | | 9/1966 |
| CA | 837922 | | 3/1970 |
| CA | 844949 | | 6/1970 |
| CA | 1007182 | | 3/1977 |
| CA | 1082657 | | 7/1980 |
| CA | 1125680 | | 6/1982 |
| CA | 1125681 | | 6/1982 |
| CA | 1152011 | | 8/1983 |
| CA | 1239885 | | 8/1988 |
| CA | 1249232 | | 1/1989 |
| CA | 1257209 | | 7/1989 |
| CA | 2021035 | A1 | 1/1991 |
| CA | 2026197 | | 8/1991 |
| CA | 2060135 | | 7/1992 |
| CA | 2150306 | | 2/1996 |
| CA | 2043958 | | 7/1996 |
| CA | 2250677 | | 4/2000 |
| CA | 2286498 | A1 | 4/2000 |
| CA | 2176080 | | 8/2001 |
| CA | 2228749 | | 10/2001 |
| CA | 2141730 | | 5/2002 |
| CA | 2197976 | | 5/2002 |
| CA | 2432791 | | 6/2002 |
| CA | 2165509 | | 7/2002 |
| CA | 2436505 | A1 | 8/2002 |
| CA | 2233356 | | 11/2002 |
| CA | 2431542 | | 12/2002 |
| CA | 2431869 | | 12/2002 |
| CA | 2219845 | | 4/2003 |
| CA | 2244689 | | 9/2003 |
| CA | 2271581 | | 12/2003 |
| CA | 2121491 | | 7/2004 |
| CA | 2542905 | A1 | 1/2005 |
| CA | 2564012 | | 11/2005 |
| CA | 114070 | | 2/2006 |
| CA | 2520024 | | 3/2006 |
| CA | 2262802 | | 6/2006 |
| CA | 2549450 | | 12/2006 |
| CA | 2608826 | | 12/2006 |
| CA | 2262458 | | 1/2007 |
| CA | 2613109 | | 1/2007 |
| CA | 2621453 | | 3/2007 |
| CA | 113773 | | 4/2007 |
| CA | 119089 | | 5/2007 |
| CA | 119090 | | 5/2007 |
| CA | 119091 | | 5/2007 |
| CA | 119092 | | 5/2007 |
| CA | 2629190 | | 5/2007 |
| CA | 118452 | | 7/2007 |
| CA | 113355 | | 9/2007 |
| CA | 115931 | | 10/2007 |
| CA | 116240 | | 10/2007 |
| CA | 116241 | | 10/2007 |
| CA | 116438 | | 10/2007 |
| CA | 119239 | | 10/2007 |
| CA | 120446 | | 10/2007 |
| CA | 2545497 | | 11/2007 |
| CA | 2588413 | | 11/2007 |
| CA | 2657721 | A1 | 1/2008 |
| CA | 116480 | | 2/2008 |
| CA | 2598153 | | 2/2008 |
| CA | 120610 | | 3/2008 |
| CA | 2520677 | | 4/2008 |
| CA | 2664625 | | 4/2008 |
| CA | 2665633 | | 4/2008 |
| CA | 114549 | | 5/2008 |
| CA | 121962 | | 5/2008 |
| CA | 2610053 | | 5/2008 |
| CA | 122120 | | 6/2008 |
| CA | 122879 | | 7/2008 |
| CA | 2267361 | | 10/2008 |
| CA | 2598691 | | 5/2009 |
| CA | 2347777 | | 7/2009 |
| CA | 2706374 | | 7/2009 |
| CA | 2311825 | | 10/2009 |
| CA | 2405786 | | 11/2009 |
| CA | 2394475 | | 1/2010 |
| CA | 128485 | | 2/2010 |
| CH | 678938 | A5 | 11/1991 |
| CN | 1082987 | A | 3/1994 |
| CN | 1128744 | A | 8/1996 |
| CN | 1237133 | A | 12/1999 |

| | | | |
|---|---|---|---|
| CN | 1272089 | A | 11/2000 |
| CN | 1288427 | A | 3/2001 |
| CN | 2484866 | Y | 4/2002 |
| CN | 2526274 | Y | 12/2002 |
| CN | 1489541 | A | 4/2004 |
| CN | 1781813 | A | 6/2006 |
| CN | 101489771 | A | 7/2009 |
| CN | 101492107 | A | 7/2009 |
| CN | 101531070 | A | 9/2009 |
| DE | 652737 | C | 11/1937 |
| DE | 18806777 | | 5/1963 |
| DE | 11 91 285 | A | 4/1965 |
| DE | 2001499 | | 7/1970 |
| DE | 8301046 | U1 | 5/1983 |
| DE | 3335833 | A1 | 4/1984 |
| DE | 19517394 | | 4/1986 |
| DE | 9115069 | U1 | 1/1992 |
| DE | 9215015 | U1 | 1/1993 |
| DE | 59002814 | | 10/1993 |
| DE | 4226313 | | 2/1994 |
| DE | 4393650 | | 11/1995 |
| DE | 4421870 | | 1/1996 |
| DE | 59303454 | | 9/1996 |
| DE | 19517392 | | 11/1996 |
| DE | 19840841 | A1 | 3/2000 |
| DE | 10056811 | A1 | 7/2001 |
| DE | 100 54 727 | A1 | 5/2002 |
| DE | 20110390 | U1 | 10/2002 |
| DE | 20310623 | U1 | 11/2003 |
| DE | 60102661 | T2 | 8/2004 |
| DE | 102004056932 | A1 | 5/2006 |
| DE | 102005017741 | A1 | 10/2006 |
| DE | 102006025612 | A1 | 11/2007 |
| DE | 102007024243 | A1 | 1/2008 |
| DE | 102007024254 | A1 | 1/2008 |
| DE | 102007030864 | A1 | 1/2008 |
| DE | 102008005403 | A1 | 7/2009 |
| DE | 102008014878 | A1 | 9/2009 |
| EA | 200900031 | A1 | 8/2009 |
| EP | 0074936 | A2 | 3/1983 |
| EP | 0 108 264 | | 10/1983 |
| EP | 0102149 | A2 | 3/1984 |
| EP | 0 371 918 | | 6/1990 |
| EP | 0408515 | A1 | 1/1991 |
| EP | 0512179 | A1 | 11/1992 |
| EP | 0653983 | A1 | 5/1995 |
| EP | 0 659 647 | | 6/1995 |
| EP | 0 683 033 | | 11/1995 |
| EP | 0 688 720 | | 12/1995 |
| EP | 0 695 692 | | 2/1996 |
| EP | 0 765 821 | | 4/1997 |
| EP | 0 812 668 | | 12/1997 |
| EP | 0929455 | A1 | 7/1999 |
| EP | 0934202 | A1 | 8/1999 |
| EP | 0 940 240 | | 9/1999 |
| EP | 1 029 656 | | 8/2000 |
| EP | 1031514 | A1 | 8/2000 |
| EP | 1 060 879 | | 12/2000 |
| EP | 1057733 | A1 | 12/2000 |
| EP | 1 157 943 | | 11/2001 |
| EP | 1203728 | A2 | 5/2002 |
| EP | 1 227 042 | | 7/2002 |
| EP | 1227042 | A1 | 7/2002 |
| EP | 1227043 | A1 | 7/2002 |
| EP | 1 254 842 | | 11/2002 |
| EP | 1 317 380 | | 6/2003 |
| EP | 1 349 789 | | 10/2003 |
| EP | 1 404 580 | | 4/2004 |
| EP | 1 404 590 | | 4/2004 |
| EP | 1 418 272 | | 5/2004 |
| EP | 1 463 670 | | 10/2004 |
| EP | 1479512 | A2 | 11/2004 |
| EP | 1 486 424 | | 12/2004 |
| EP | 1 512 527 | | 3/2005 |
| EP | 1 547 762 | | 6/2005 |
| EP | 1 637 457 | | 3/2006 |
| EP | 1 656 300 | | 5/2006 |
| EP | 1 670 688 | | 6/2006 |
| EP | 1 687 213 | | 8/2006 |
| EP | 1 699 326 | | 9/2006 |
| EP | 1712490 | A2 | 10/2006 |
| EP | 1714912 | A1 | 10/2006 |
| EP | 1 719 715 | | 11/2006 |
| EP | 1 739 029 | | 1/2007 |
| EP | 1 744 964 | | 1/2007 |
| EP | 1785370 | A1 | 5/2007 |
| EP | 1 876 106 | | 1/2008 |
| EP | 1 625 079 | | 2/2008 |
| EP | 1 894 847 | | 3/2008 |
| EP | 1 921 023 | | 5/2008 |
| EP | 1 939 099 | | 7/2008 |
| EP | 1975083 | A2 | 10/2008 |
| EP | 1 990 184 | | 11/2008 |
| EP | 2 049 325 | | 4/2009 |
| EP | 2 049 326 | | 4/2009 |
| EP | 2043853 | A1 | 4/2009 |
| EP | 2080715 | A1 | 7/2009 |
| EP | 2108506 | A2 | 10/2009 |
| EP | 2 128 041 | | 12/2009 |
| EP | 2 147 871 | | 1/2010 |
| EP | 2 199 222 | | 6/2010 |
| EP | 2 202 178 | | 6/2010 |
| EP | 2 238 046 | | 10/2010 |
| ES | 2045882 | T3 | 1/1994 |
| ES | 2093443 | T3 | 12/1996 |
| ES | 2218361 | T3 | 11/2004 |
| FR | 791981 | A | 12/1935 |
| FR | 14 90 636 | | 6/1967 |
| FR | 2160489 | A1 | 6/1973 |
| FR | 2533894 | A1 | 4/1984 |
| FR | 2813861 | A1 | 3/2002 |
| GB | 321176 | A | 10/1929 |
| GB | 0445661 | A | 4/1936 |
| GB | 484990 | A | 5/1938 |
| GB | 1261531 | A | 1/1972 |
| GB | 1261532 | A | 1/1972 |
| GB | 1261533 | A | 1/1972 |
| GB | 2 016 640 | | 9/1979 |
| GB | 1 554 241 | | 10/1979 |
| GB | 2 044 076 | | 10/1980 |
| GB | 2 055 737 | | 3/1981 |
| GB | 2 061 699 | | 5/1981 |
| GB | 2 073 581 | | 10/1981 |
| GB | 2074124 | A | 10/1981 |
| GB | 2 077 177 | | 12/1981 |
| GB | 2 078 094 | | 1/1982 |
| GB | 2130168 | A | 5/1984 |
| GB | 2333087 | A | 7/1999 |
| GB | 2 359 295 | | 8/2001 |
| GB | 2420267 | | 5/2006 |
| GB | 2425041 | A | 10/2006 |
| GB | 2426045 | A | 11/2006 |
| GB | 2445287 | A | 7/2008 |
| HK | 1034700 | A1 | 4/2004 |
| HK | 1063172 | A1 | 8/2006 |
| IT | 1366725 | | 2/2006 |
| IT | MI0020060589 | | 6/2006 |
| JP | 50052003 | A | 5/1975 |
| JP | 50120802 | A | 10/1975 |
| JP | 51140989 | | 12/1976 |
| JP | 53060441 | | 5/1978 |
| JP | 55134046 | | 10/1980 |
| JP | 56156777 | A | 11/1981 |
| JP | 58-81159 | | 5/1983 |
| JP | 59-94076 | | 5/1984 |
| JP | 60-154235 | | 8/1985 |
| JP | 60-242490 | | 12/1985 |
| JP | 62-143663 | | 6/1987 |
| JP | 2509655 (Y2) | | 8/1989 |
| JP | 2-307738 | | 12/1990 |
| JP | 3023014 | U | 3/1991 |
| JP | 4-32908 | | 2/1992 |
| JP | 4097833 | A | 3/1992 |
| JP | 04097833 | A | 3/1992 |
| JP | 4-45215 | | 4/1992 |
| JP | 4-68848 | | 6/1992 |
| JP | 50-67002 | | 3/1993 |
| JP | 5-84621 | | 11/1993 |

| | | | |
|---|---|---|---|
| JP | 06048474 | A | 2/1994 |
| JP | 8-207924 | | 8/1996 |
| JP | 8-310571 | | 11/1996 |
| JP | 9-132224 | | 5/1997 |
| JP | 10-175627 | | 6/1998 |
| JP | 11314286 | A | 11/1999 |
| JP | 11321936 | A | 11/1999 |
| JP | 11342982 | A | 12/1999 |
| JP | 2000033931 | A | 2/2000 |
| JP | 2000095228 | A | 4/2000 |
| JP | 2000103478 | A | 4/2000 |
| JP | 2000103479 | A | 4/2000 |
| JP | 2000118520 | A | 4/2000 |
| JP | 3063644 | | 5/2000 |
| JP | 2000-203664 | | 7/2000 |
| JP | 2000190943 | A | 7/2000 |
| JP | 2000203664 | A | 7/2000 |
| JP | 2000-238739 | | 9/2000 |
| JP | 2000281044 | A | 10/2000 |
| JP | 2001-2051 | | 1/2001 |
| JP | 2001-98355 | | 4/2001 |
| JP | 2001097355 | A | 4/2001 |
| JP | 2001171642 | A | 6/2001 |
| JP | 2001180647 | A | 7/2001 |
| JP | 2001293802 | A | 10/2001 |
| JP | 2001294282 | A | 10/2001 |
| JP | 3248718 | A | 2/2002 |
| JP | 3274412 | A | 4/2002 |
| JP | 2002-128049 | | 5/2002 |
| JP | 2003276721 | A | 10/2003 |
| JP | 2004090928 | A | 3/2004 |
| JP | 2004090929 | A | 3/2004 |
| JP | 2004-99079 | | 4/2004 |
| JP | 2004522654 | T | 7/2004 |
| JP | 2004-314987 | | 11/2004 |
| JP | 2004315065 | A | 11/2004 |
| JP | 2005-059946 | | 3/2005 |
| JP | 2006143331 | A | 6/2006 |
| JP | 2008-529549 | | 8/2008 |
| JP | 2009173346 | A | 8/2009 |
| KR | 2006056859 | | 5/2006 |
| NL | 42544 | C | 2/1938 |
| NZ | 506739 | | 11/2001 |
| NZ | 519160 | | 12/2003 |
| SG | 0117419 | A1 | 12/2005 |
| TR | 200400866 | T4 | 6/2004 |
| TW | 393427 | B | 6/2000 |
| TW | 399609 | Y | 7/2000 |
| WO | 9403326 | A1 | 2/1994 |
| WO | 9832601 | A2 | 7/1998 |
| WO | 9911526 | A1 | 3/1999 |
| WO | 9922686 | A1 | 5/1999 |
| WO | 9959883 | A1 | 11/1999 |
| WO | 0017058 | A1 | 3/2000 |
| WO | 0028288 | A1 | 5/2000 |
| WO | WO 01/38180 | | 5/2001 |
| WO | 0204300 | A1 | 1/2002 |
| WO | WO 02/30783 | | 4/2002 |
| WO | 0247523 | A1 | 6/2002 |
| WO | WO 02/49924 | | 6/2002 |
| WO | 02060767 | | 8/2002 |
| WO | 03057577 | | 7/2003 |
| WO | WO 2004/103845 | | 12/2004 |
| WO | WO 2005/012114 | | 2/2005 |
| WO | WO 2005/047126 | | 5/2005 |
| WO | 2005054082 | A1 | 6/2005 |
| WO | WO 2005/053487 | | 6/2005 |
| WO | 2005075319 | A1 | 8/2005 |
| WO | WO 2005/100167 | A1 | 10/2005 |
| WO | WO 2005/102847 | | 11/2005 |
| WO | 2007028623 | A1 | 3/2007 |
| WO | WO 2007/036928 | A3 | 4/2007 |
| WO | 2007054179 | A2 | 5/2007 |
| WO | 2007054318 | A1 | 5/2007 |
| WO | WO 2007/078446 | A2 | 7/2007 |
| WO | WO 2007/090415 | A1 | 8/2007 |
| WO | WO 2007/091068 | A2 | 8/2007 |
| WO | WO 2007/094838 | A2 | 8/2007 |
| WO | WO 2007/126783 | A1 | 11/2007 |
| WO | 2008009371 | A1 | 1/2008 |
| WO | 2008009372 | A1 | 1/2008 |
| WO | WO 2008/014230 | | 1/2008 |
| WO | WO 2008/022180 | A2 | 2/2008 |
| WO | WO 2008/026161 | A2 | 3/2008 |
| WO | WO 2008/042378 | | 4/2008 |
| WO | WO 2008/045708 | A1 | 4/2008 |
| WO | WO 2008/045944 | A2 | 4/2008 |
| WO | 2008067865 | A1 | 6/2008 |
| WO | WO 2008/107657 | A1 | 9/2008 |
| WO | WO 2008/119938 | A1 | 10/2008 |
| WO | WO 2008/123783 | A1 | 10/2008 |
| WO | WO 2008/146115 | A1 | 12/2008 |
| WO | WO 2009/021305 | A2 | 2/2009 |
| WO | WO 2009/032837 | A1 | 3/2009 |
| WO | WO 2009/034323 | A2 | 3/2009 |
| WO | WO 2009/039632 | A1 | 4/2009 |
| WO | WO 2009/059352 | A1 | 5/2009 |
| WO | WO 2009/074285 | A2 | 6/2009 |
| WO | 2009092557 | A1 | 7/2009 |
| WO | WO 2009/082660 | A1 | 7/2009 |
| WO | WO 2009/092557 | | 7/2009 |
| WO | WO 2009/118772 | A1 | 10/2009 |
| WO | WO 2010/008629 | A1 | 1/2010 |
| WO | WO 2010/011627 | A1 | 1/2010 |
| WO | WO 2010/019146 | A1 | 2/2010 |
| WO | WO 2010/031764 | A2 | 3/2010 |
| WO | WO 2010/034869 | A1 | 4/2010 |
| WO | WO 2010/036645 | A1 | 4/2010 |
| WO | WO 2010/067047 | A1 | 6/2010 |

OTHER PUBLICATIONS

Statement of Case in Support of Notice of Opposition to Grant of Patent (Section 21) in New Zealand Patent Application No. 543602, Mar. 28, 2007, 16 paqes.

International Search Report from International Application No. PCT/EP2006/009933, dated Oct. 4, 2007, 5 pages.

International Search Report mailed Jan. 15, 2007, in PCT/EP2006/008753.

International Search Report from Corresponding International Application No. PCT/EP2005/005406, dated Aug. 25, 2005, 2 pages.

Search Report for DE 203 19 691.0 mailed Aug. 24, 2004.

Minutes of the oral proceedings before the Opposition Division for Patent No. EP-B-1785370.

Decision—Minutes of the oral proceedings before the Opposition Division in EP-B-1785370.

EPO Communication dated Oct. 20, 2010, based on EP 1976683.

Notice of Reasons for Rejection from the Japanese Patent Office in Japanese Patent Appln. No. 2008-539346.

* cited by examiner

INSULATED CUP

RELATED APPLICATIONS

This application is a U.S. nationalization of PCT application No. PCT/EP2006/010767 filed on Nov. 9, 2006, and claims priority to EP Patent Application No. 05024667.7 filed on Nov. 11, 2005, the contents of which are incorporated herein by reference in their entirety.

The present invention is related to a cup according to the preamble of claim 1.

Such a cup is known, for example, from DE 100 54 727 A1. The main purpose of these cups is to store cold or hot beverages. The corrugated material of the external sleeve provides for a thermal isolation of the cup. By means of this thermal isolation, the liquid in the cup may maintain its temperature for a longer time, and the consumer may more easily handle the cup, since the outer side of the cup neither becomes too hot, nor too cold.

The cup of DE 100 54 727 A1 is manufactured by providing adhesive on two opposing edges of the blank of corrugated material. After attaching the first edge of the blank to the internal wall of the cup, the blank is drawn around the internal wall, until the second edge overlaps the first edge and becomes adhesively attached to this first edge. Preferably, this conventional cup is manufactured in such a way that the flat substrate layer of the sleeve faces outwards, thereby facilitating printing on the sleeve.

Another container is known from U.S. Pat. No. 5,772,111. This container, however, is rather different from the cup of DE 100 54 727 A1, since it is devoid of an internal wall. Instead, the container is formed by merely closing a blank of corrugated material into a conical shape and providing a container bottom. This container is formed in such a way that the corrugated layer faces outwards. However, compared to the cup of DE 100 54 727 A1, the container of U.S. Pat. No. 5,772,111 is less stable and offers a lower degree of thermal isolation, due to the reduced number of layers.

The object of the present invention is to improve the known cup with respect to its stability, its aesthetic appearance and a facilitated way of manufacturing.

This object is solved by a cup with the features of claim 1. Advantageous embodiments of the invention are referred to by the dependent claims.

According to the invention, the second area of adhesive, i.e. the area of adhesive on the overlapping end of the blank for the sleeve, is provided at a distance from the second or preferably overlapping edge of the blank. This is in clear contrast to the cup of DE 100 54 727 A1, according to which this second area of adhesive is provided exactly at the overlapping edge of the blank in order to directly attach this overlapping edge to the underlying edge of the blank and to thereby close the sleeve. The present invention, on the other hand, teaches to locate the second area of adhesive at a distance from the overlapping edge, thereby enabling to directly attach the overlapping edge of the blank to the internal wall of the cup. In other words, instead of closing the sleeve by an adhesive joint, the two ends of the blank are separately attached to the internal wall. This offers several advantages. Stability of the cup is enhanced by fixing each end of the blank separately to the internal wall. In the event that one adhesive joint becomes weak, the sleeve will still remain stably fixed to the internal wall of the cup. Further, the width of the overlap may be reduced significantly, since this overlapping area is not needed anymore for a mutual attachment of the two ends of the blank. By reducing the overlap, for example to a value of less than 1 mm or merely a few millimeters, material of the sleeve is saved, thereby also reducing manufacturing costs. In addition, the aesthetic appearance of the cup is improved, since the removal of adhesive from the overlap has to avoid unwanted leakage of adhesive from the overlap onto the exterior of the cup. Moreover, by being able to reduce the width of the overlap and by being able to avoid an additional layer of adhesive at the overlap, the thickness of the cup at the overlap can be reduced which, in turn, facilitates stacking of the cups without jamming. Thus, de-nesting of the cups is improved. This facilitates handling of the cups and reduces storage costs.

In a preferred embodiment, the distance of the second area of adhesive from the overlapping edge is at least as large as the width of the overlapping area. This ensures to keep the overlap free from adhesive, thereby restricting the wall thickness of the overlap and further avoiding the leakage of adhesive.

Depending on the cut of the blank of corrugated material, the overlap may have a constant width, but the width does not necessarily have to be constant. In particular, this width of the overlapping area may have a value between 0 and 4 mm, preferably between 0.5 and 2.5 mm. Depending on the size of the cup, this overlap may, of course, also be broader.

For the distance of the second area of adhesive from the overlapping edge, a value of 0.5 mm to 8 mm, and more particularly a value of 0.5 to 5 mm is preferred. In particular, this distance should be chosen large enough to ensure that no adhesive will leak through the overlapping area onto the exterior of the cup.

In an advantageous embodiment of the invention, the overlapping area is completely free of adhesive between the two overlapping ends of the blank. In such an embodiment, the risk of leakage of adhesive is further reduced.

It may also be contemplated to provide the other, first area of adhesive at a distance from the corresponding edge of the blank. When choosing this distance of the first area of adhesive from the overlapping edge appropriately, for example at least as large as the width of the overlapping area, the presence of adhesive between the internal wall of the cup and the sleeve may be avoided underneath the overlap. This will help to further reduce the resulting wall thickness at the overlap, thereby facilitating stacking.

According to an embodiment of the present invention, the corrugated layer of the sleeve material has wavepeaks spaced apart from the substrate layer, these wavepeaks extending in straight lines or in a wave-like pattern or in a zigzag pattern. The volume between the substrate layer and the wavepeaks has the major influence on the thermal isolation of the cup. If desired, this volume may also be filled with a certain material, for example by foam, in order to further enhance the thermal isolation properties.

By having adjacent wavepeaks of the corrugated material arranged at a constant distance, manufacturing costs of the cup may further be reduced since the blank for the sleeve may be cut from any portion of the corrugated material without worrying about the exact location of the cut.

The width of the overlapping area of the sleeve is preferably chosen to be less than three times the average distance between adjacent wavepeaks of the corrugated material, even more preferred less than twice the average distance between adjacent wavepeaks. Such a comparatively short overlap helps to save material, thereby reducing manufacturing costs, and to avoid the outer, overlapping edge from detaching from the cup.

The first area of adhesive and/or the second area of adhesive advantageously comprises at least one strip of adhesive, in order to form a strong bond between the corresponding end of the blank and the internal wall of the cup.

The strip of adhesive may, for example, be arranged parallel to the corresponding edge of the blank. This can ensure that no portion of the edge may detach further from the internal wall than other portions, if at all.

In addition or alternatively to a strip of adhesive, the first area of adhesive and/or the second area of adhesive may comprise at least one spot or dot of adhesive. Without significantly affecting stability of the cup, this may reduce the amount of adhesive used, thereby further decreasing manufacturing costs and helping to prevent leakage of adhesive through the overlap.

In a preferred embodiment, several of such spots of adhesive are arranged on a line parallel to the corresponding edge of the blank, having similar effects with respect to stability of the cup as a strip of adhesive, but with a reduced amount of adhesive.

In addition to the first and second areas of adhesive, at least one additional area of adhesive may also be provided between the first and second areas elsewhere on the sleeve. By attaching the sleeve to the internal wall at a third or further position, stability of the cup and sleeve assembly may further be enhanced.

Advantageous materials for the sleeve are plastic or cardboard material. Of course, other suitable materials may also be used.

A significant advantage may be achieved by providing the internal wall of the cup with de-nesting means. Such de-nesting means prevent jamming of the cups when stacking several identical cups into one another. This allows to more easily separate the stacked cups.

For example, the de-nesting means may be shaped as at least one projection which projects from the internal wall into the interior of the cup. When being stacked, the upper cup may rest with its bottom wall on the de-nesting projection of the lower cup, which prevents the cups from being stacked too tightly.

Such a de-nesting projection may, in turn, comprise a circumferential projection and/or at least one sectional projection, for example a step or a dimple. When providing such a projection only on the interior wall of the cup, the outer appearance of the cup is not negatively influenced.

Figure 2:
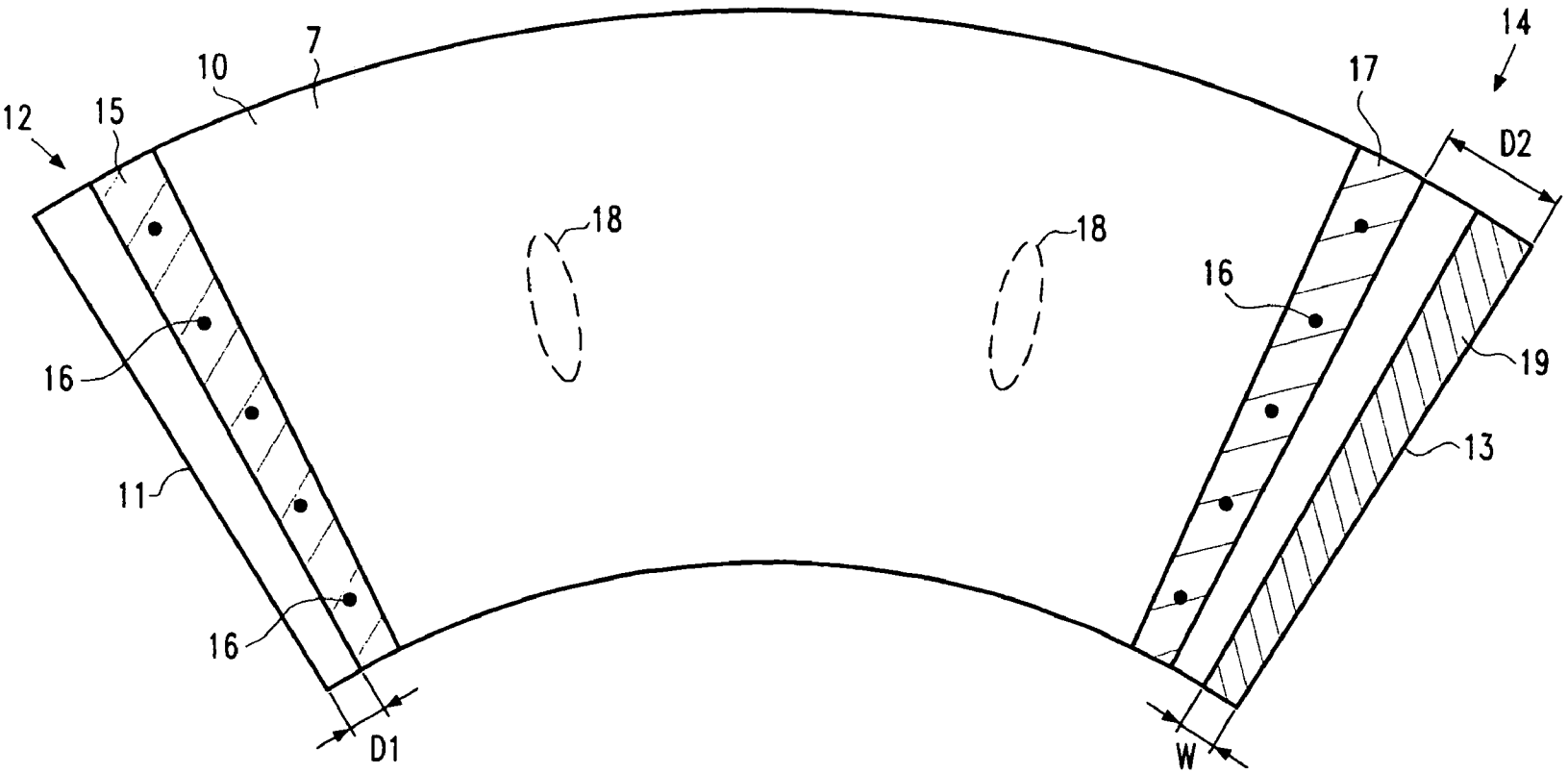
Figure 3:
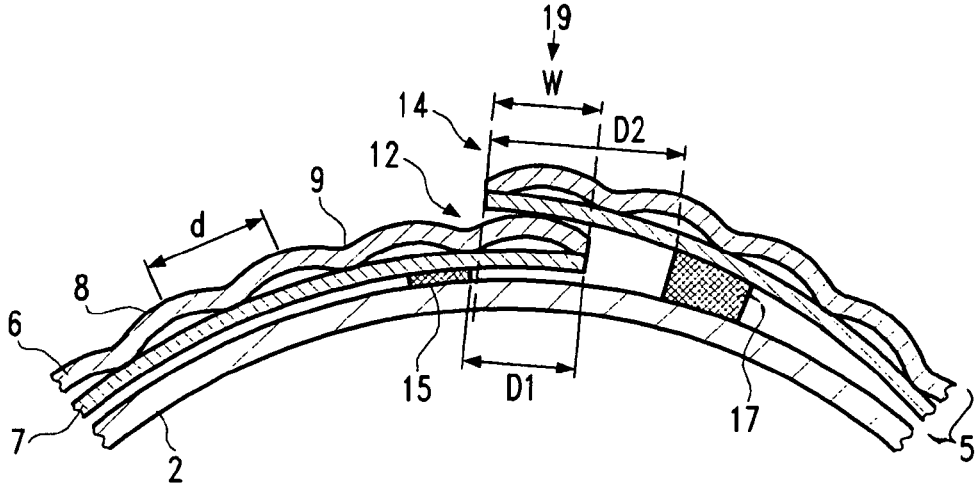
Figure 4:
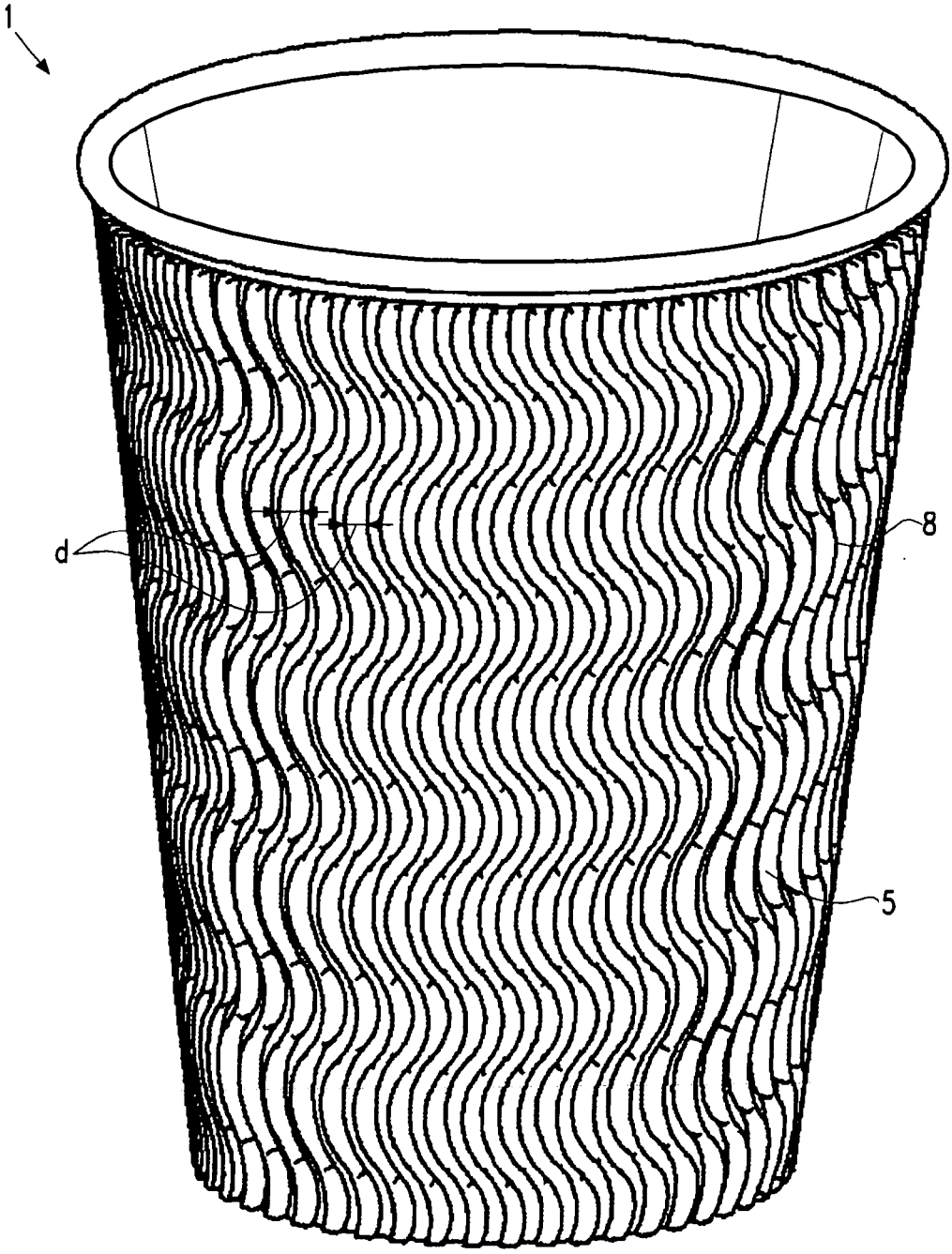
Figure 5:
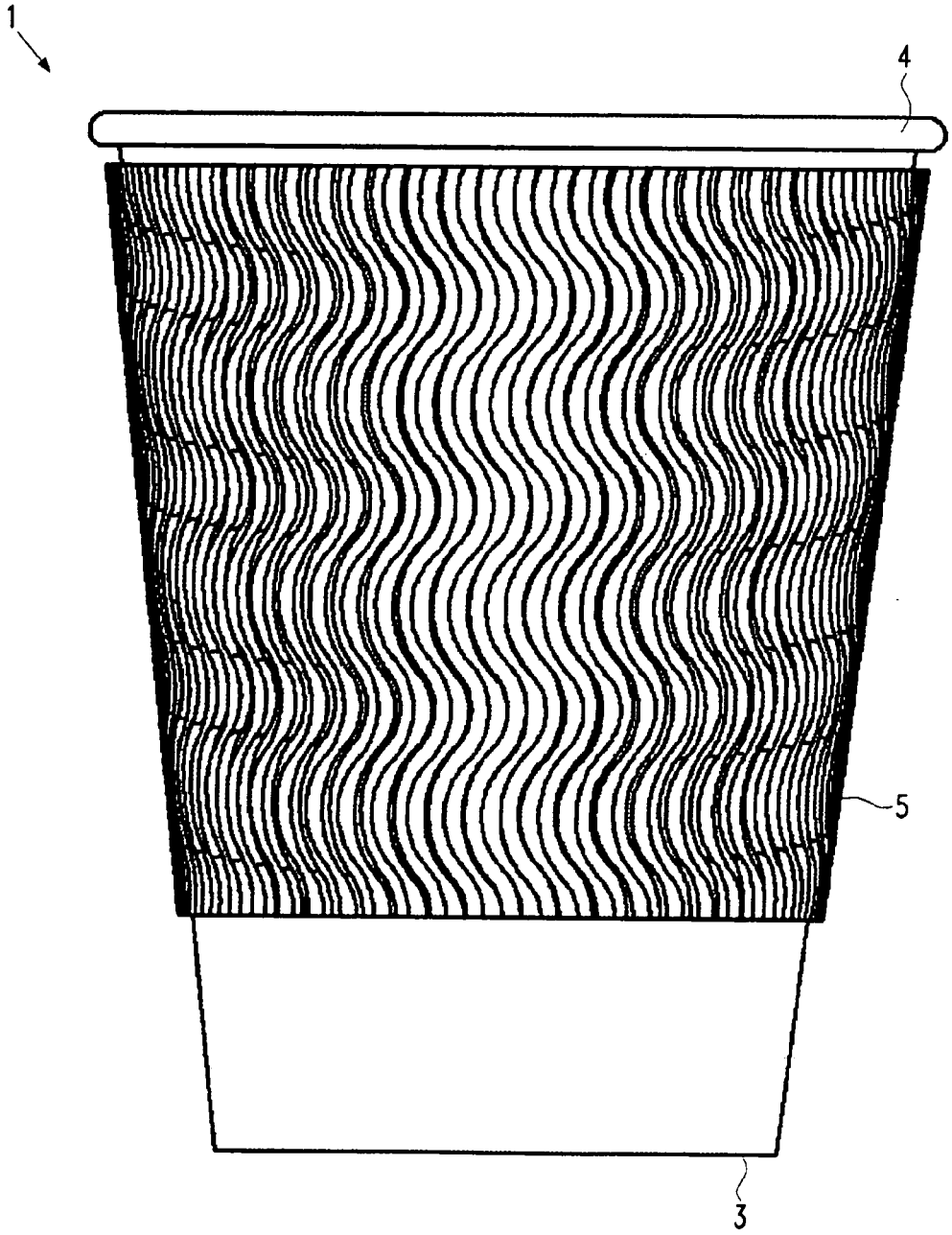
Figure 6:
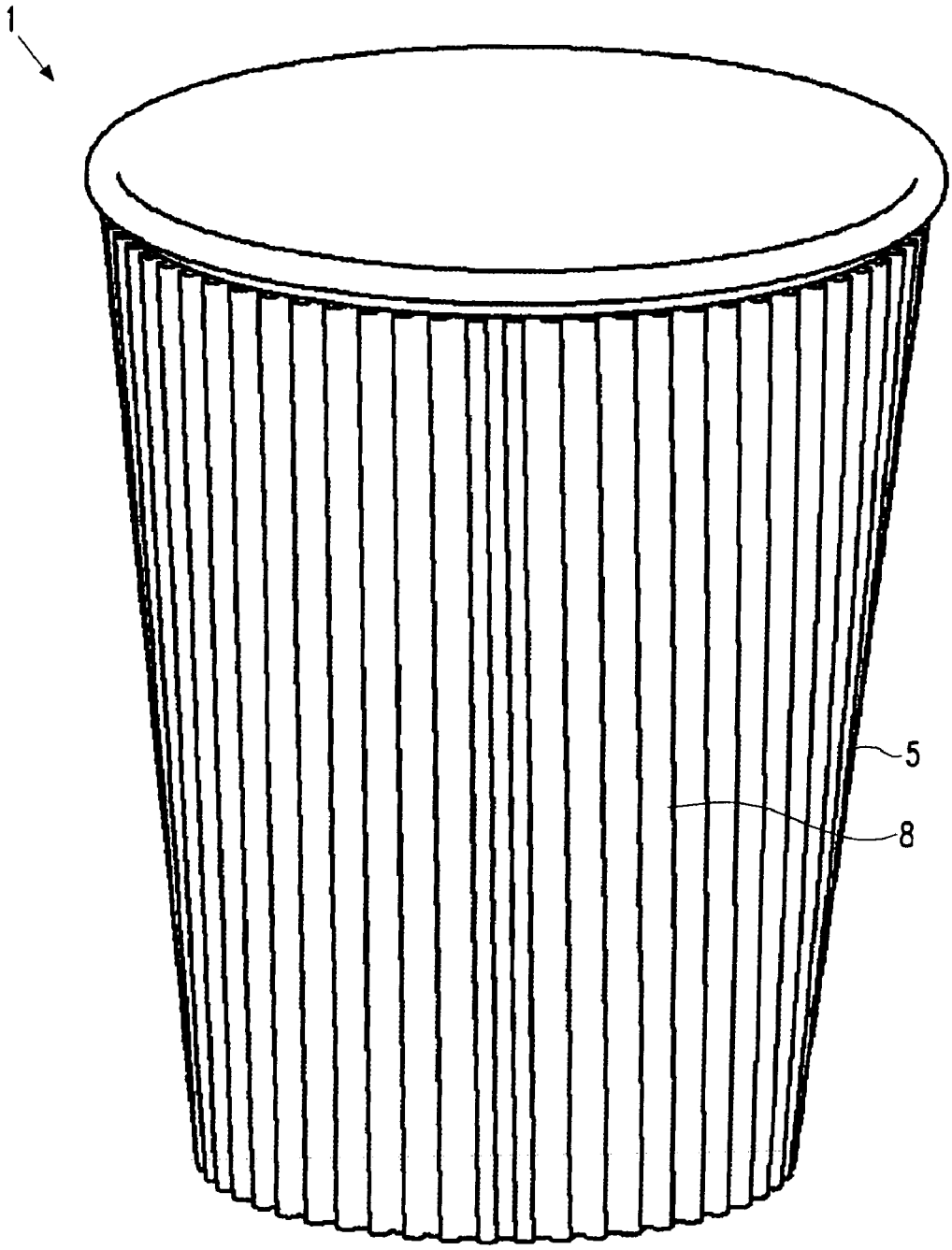

Some embodiments of the present invention will now be described in more detail with reference to the attached drawings. In particular, FIG. 1 shows a perspective view of a preferred embodiment of a cup according to the present invention, FIG. 2 shows the blank of the sleeve used for the cup in FIG. 1, FIG. 3 shows a horizontal section of the overlapping area of the cup shown in FIG. 1, FIG. 4 shows a perspective view of a second embodiment, FIG. 5 shows a front view of a third embodiment, and FIG. 6 shows a perspective view of a fourth embodiment of a cup according to the present invention.

Corresponding features are referred to by the same reference numerals throughout the drawings.

FIG. 1 shows a preferred embodiment of a cup 1 according to the present invention. The cup comprises an internal wall 2, which has a frustro-conical shape, the lower end being closed by a cup bottom 3. The opposite, upper end of the cup is provided with a broad rim 4, which may for example be formed as a rolled upper end of the internal wall 2.

On the outside, the cup 1 is provided with an external sleeve 5, which extends over the complete height of the internal wall 2, i.e. from the cup bottom 3 to the upper rim 4. This sleeve 5 is formed from a blank of corrugated material, in particular cardboard material, comprising a corrugated layer 6 and a substrate layer 7, c.f. FIG. 3. As shown in FIGS. 1 and 3, the sleeve 5 is arranged in such a way that the substrate layer 7 faces towards the internal wall 2 of the cup 1, while the corrugated layer 6 faces towards the outside of the cup 1. This corrugated layer 6 comprises wavepeaks 8, at which the corrugated layer 6 is spaced apart from the substrate layer 7. Each wavepeak 8 extends in a wave-like pattern at a slightly inclined angle from the cup bottom 3 to the rim 4. Each pair of adjacent wavepeaks 8 is arranged at a constant distance d from each other. Between the wavepeaks 8, there is a trough 9, at which the corrugated layer 6 and the substrate layer 7 are attached to each other.

The sleeve 5 of the cup 1 is formed from an initially flat blank 10 of corrugated material, as shown in FIG. 2. This blank 10 is shaped in such a way that, when being closed, it forms a frustro-conical sleeve 5, the conicity of which corresponds to the conicity of the internal wall 2. In this shape, the blank 10 may be cut from a larger area of corrugated material.

As shown in FIG. 2, the blank 10 of corrugated material may be formed as a slightly curved strip of material, having a first edge 11 at a first end 12 of the strip and a second edge 13 at an opposite, second end 14 of the strip. Parallel to the first edge 11, but spaced apart by a distance D1 from the first edge 11, a first area 15 of adhesive is provided on the internal side of the blank 10, i.e. on the substrate layer 7. This first area 15 of adhesive is shown hatched in FIG. 2. On the first area 15 of adhesive, adhesive is provided in the form of several spots or dots 16, which are spaced at regular intervals on the first area 15 of adhesive. In particular, these spots 16 of adhesive are arranged on a line which extends substantially parallel to the first edge 11 of the blank 10.

In corresponding relationship to the opposite, second edge 13 of the blank 10, but spaced apart from this second edge 13 by a distance D2, a second area 17 of adhesive is provided on the blank 10. Similar to the first area 15, this second area 17 of adhesive also comprises a number of discrete spots 16 of adhesive, which are arranged on a line extending substantially parallel to the second edge 13 of the blank 10. Instead of providing a number of discrete spots 16 of adhesive, or in addition to these spots 16, the adhesive may also be provided in the form of a strip on the respective area 15, 17 of adhesive, or in other suitable arrangements. In addition, adhesive may optionally also be provided on additional areas 18 of adhesive between the first area 15 and the second area 17. Preferably, the adhesive on the first and second areas 15, 17 is hot melt glue, which allows a fast assembly, while the adhesive on the additional area(s) 18 is cold glue, which achieves a stronger adhesion. If speed of the assembly is not an issue, cold glue may also be used as the adhesive on the first and/or second areas.

In order to manufacture the cup 1, the blank 10 for the sleeve is initially formed separately from the rest of the "bare" cup 1. In particular, the blank 10 can be cut from a larger sheet of corrugated material. After providing adhesive on the blank 10 on the first area 15, the second area 17 and—optionally—also on the additional area(s) 18, the blank 10 is formed around the "bare" cup 1. In order to do so, the first end 12 of the blank 10 is pressed against the cup 1 and attached to the exterior of the internal wall 2 by means of the adhesive 16 on the first area 15 of adhesive. Consecutively, the blank 10 is wrapped or drawn around the internal wall 2 and attached to the internal wall 2 by the adhesive on the areas 18 and, eventually, by the adhesive 16 on the second area 17 of adhesive. As an alternative to providing adhesive on all areas on the blank 10 simultaneously, the adhesive may also be applied sequentially during the formulation of the blank 10 around the internal wall 2. In another alternative method, the blank first contacts the bare cup with its center, before the two ends 12, 14 of the blank are wrapped around the cup symmetrically and each end attached separately to the internal wall 2. A clamp can be used for pressing the two ends 12, 14 together and onto the cup 1.

Eventually, when the blank 10 is formed all around the internal wall 2, in order to form a sleeve 5 covering the internal wall 2, the second end 14 of the blank 10 overlaps the first end 12. In particular, the overlap 19 has a width W, as shown in FIGS. 2 and 3. Although this width W is preferably not larger than the distance d between two adjacent wavepeaks 8, it may also be broader, depending on the value of the distance d.

Although the distance D1 spacing apart the first edge 11 from the first area 15 of adhesive may be zero, it is preferably non-zero, especially when in the absence of an overlap or W=0, even more preferred at least as large as the width W of the overlap. While still being close enough to the first edge 11 of the blank 10 in order to avoid a detachment of the blank 10 from the internal wall 2, the relation of D1 being at least as large as W allows the overlapping area to be free of adhesive between the first end 12 of the blank 10 and the internal wall 2. Thus, the wall thickness at the overlap can be reduced, while still offering sufficient stability of the assembly.

As also shown in FIGS. 2 and 3, the distance D2 between the second edge 13 and the second area 17 of adhesive is at least as large as the width W of the overlap, preferably only slightly larger than the width W if W is non-zero. The result of this arrangement can be seen in FIG. 3: after the attachment between the second end 14 of the blank 10 to the internal wall 2 at the second area 17 of adhesive, the second end 14 of the sleeve 5 opens outwards, in order to be able to overlap the first end 12 of the blank 10. The over-lapping area 19 is shown hatched in FIG. 2. It has a width W between 0 and 4 mm, preferably between 0.5 and 2.5 mm. Such a small width W with the above described advantages of saving material and improving the aesthetic appearance of the cup 1 is made possible by the present invention by arranging the second area 17 of adhesive at a non-zero distance D2 from the overlapping edge 13 of the blank 10. Instead of attaching the two ends 12, 14 of the blank 10 to each other and then to the internal wall 2, as it is done in the prior art, the present invention teaches to attach each end 12, 14 of the blank 10 separately to the internal wall 2. While this provides excellent stability of the assembly, the overlapping area 19 can be made devoid of adhesive between the first end 12 and the second end 14 of the blank 10. In turn, the width W of the overlapping area 19 may be reduced to such a small value. Nevertheless, by fixing both ends 12, 14 of the blank 10 separately to the internal wall 2 a detachment of each end 12, 14 is achieved even more securely than in the prior art.

As an additional feature, which is also shown in FIG. 1, the cup 1 of the present invention may be provided with de-nesting means 20. In the embodiment shown in FIG. 1 the de-nesting means 20 are formed as a step or projection which projects from the internal wall 2 into the interior of the cup 1. Depending on the conicity of the cup 1, the projection 20 is arranged at such a height from the bottom 3 that—when stacking the cups 1—an upper cup 1 may rest on the de-nesting projection 20 of a lower cup 1 with its bottom 3 before being stacked into the lower cup 1 too tightly. The de-nesting projection 20 may be formed as a circumferential projection extending all around the circumference of the cup 1, or as one or several spaced apart sectional projections on the same height over the bottom 3 of the cup 1.

FIG. 4 shows a perspective view of a second embodiment of a cup according to the present invention. In contrast to the first embodiment, the distance d between adjacent wavepeaks 8 is smaller.

A third embodiment of the present invention is shown in FIG. 5. The sleeve 5 of the cup 1 shown in FIG. 5 has a reduced height, i.e. its height is smaller than the distance between the cup bottom 3 and the rim 4.

Another embodiment of a cup 1 is shown in FIG. 6. This embodiment differs from the preceding embodiments in that the wavepeaks 8 on the corrugated material of the sleeve 5 extend in straight lines instead of extending in a wave-like pattern. Of course, the sleeve 5 of this embodiment may also be made smaller, i.e. extending over less than the complete height of the cup 1.

Starting from the embodiment shown in the attached drawings and described with respect thereto, the cup 1 of the present invention may be varied in several ways. For example, the wavepeaks of the corrugated material may extend in straight lines, in a zig-zag pattern or with varying distances between adjacent wavepeaks 8. The space between the substrate layer and the corrugated layer 6 does not have to be empty but can be filled with a suitable material for enhancing thermal isolation properties, such as foam. Further, the internal wall 2 of the cup 1 does not have to be formed form one single layer only, but it may be formed in a double wall shape. A less expensive version of the cup 1 may be formed without the de-nesting means 20, and without additional areas 18 of adhesive. Further variations are also possible.

The invention claimed is:

1. Cup with an internal wall and an external sleeve wrapped around the internal wall in a circumferential direction, the sleeve being formed from a blank of corrugated material comprising a corrugated layer and a substrate layer and being arranged such that the substrate layer faces towards the internal wall of the cup, a first end of the blank is overlapped at least partially by a second end of the blank in an overlapping area, the sleeve is adhesively attached to the internal wall at least by a first area of adhesive being provided on an inner side of the sleeve on the first end of the blank, the sleeve is adhesively attached to the internal wall by a second area of adhesive being provided on an inner side of the sleeve on the second end of the blank, the second area of adhesive provided at a distance from an edge at the second end of the blank, a distance (D2) of the second area of adhesive from the overlapping edge is between 0.5 mm and 5 mm and at least as large as a width (W) of the overlapping area, wherein the overlapping area is free of adhesive between the two overlapping ends of the blank, and the first area of adhesive is separated from the second area of adhesive in the circumferential direction by an area that is free of adhesive.

2. Cup according to claim 1, wherein the width (W) of the overlapping area is between greater than 0 mm and not greater than 4 mm.

3. Cup according to claim 1, wherein the width (W) of the overlapping area is between 0.5 and 2.5 mm.

4. Cup according to claim 1, wherein the overlapping area is free of adhesive between the two overlapping ends of the blank.

5. Cup according to claim 4, wherein the first area of adhesive is provided at a distance (D1) from the corresponding edge of the blank.

6. Cup according to claim 5, wherein the distance (D1) of the first area of adhesive from the overlapped edge is at least as large as the width (W) of the overlapping area.

7. Cup according to claim 6, wherein the corrugated layer has wavepeaks spaced apart from the substrate layer the wavepeaks extending in straight lines or in a wavelike pattern or in a zigzag pattern.

8. Cup according to claim 7, wherein the distance (d) between adjacent wavepeaks is constant.

9. Cup according to claims 7 or 8, wherein the width (W) of the overlapping area is less than three times the average distance (d) between adjacent wavepeaks.

10. Cup according to claim 1, wherein the first area of adhesive or the second area of adhesive comprises at least one strip of adhesive.

11. Cup according to claim 10 wherein the strip is arranged parallel to the corresponding edge (11, 13) of the blank (10).

12. Cup according to claim 1, wherein the first area of adhesive and/or the second area of adhesive comprises at least one spot of adhesive.

13. Cup according to claim 12, wherein several spots of adhesive are arranged on a line parallel to the corresponding edge of the blank.

14. Cup according to claim 1, wherein at least one additional area of adhesive is provided between the first and the second areas of adhesive.

15. Cup according to claim 14, wherein a hot melt glue is provided on the first area of adhesive and/or on the second area of adhesive.

16. Cup according to claim 1, wherein cold glue is provided on at least one additional area of adhesive.

17. Cup according to claim 1, wherein the sleeve is made from plastic or cardboard material.

18. Cup according to claim 1, wherein the internal wall of the cup is provided with de-nesting means.

19. Cup according to claim 18, wherein the de-nesting means are shaped as at least one projection projecting into the interior of the cup.

20. Cup according to claim 19, wherein the projection comprises a circumferential projection and/or at least one sectional projection.

21. Cup according to claim 1 wherein the first adhesive area is spaced apart from the second adhesive area.

22. Cup according to claim 1 wherein the area that is free of adhesive includes at least part of the overlapping area.

23. A cup comprising:

an internal wall; and an external sleeve wrapped around the internal wall in a circumferential direction and comprising a blank with a corrugated layer and a substrate layer, wherein the blank comprises:

a first edge at a first end of the blank; and a second edge at a second end of the blank opposite the first end of the blank in the circumferential direction, wherein the second end of the blank extends over the first end of the blank to define an overlapping area that extends from a bottom of the blank to a top of the blank in a longitudinal direction;

a first area of adhesive attaching the first end of the blank to the internal wall; and a second area of adhesive attaching the second end of the blank to the internal wall, the second area of adhesive is separated in the circumferential direction from the first area of adhesive by an area that is free of adhesive, and the area that is free of adhesive includes at least part of the overlapping area.

24. The cup of claim 23 wherein the first area of adhesive is more than 0 mm and less than 4 mm from the first edge of the blank, and the second area of adhesive is at between 0.5 mm and 5 mm from the second end of the blank.

* * * * *